US008677673B2

(12) United States Patent
Ziegler

(10) Patent No.: US 8,677,673 B2
(45) Date of Patent: Mar. 25, 2014

(54) TELESCOPIC-SIGHT MOUNTING SYSTEM FOR A FIREARM

(76) Inventor: Gerhard Ziegler, Georgensgmuend (DE)

( * ) Notice: Subject to any disclaimer, the term of this patent is extended or adjusted under 35 U.S.C. 154(b) by 343 days.

(21) Appl. No.: 13/174,954

(22) Filed: Jul. 1, 2011

(65) Prior Publication Data

US 2012/0000110 A1 Jan. 5, 2012

(30) Foreign Application Priority Data

Jul. 5, 2010 (DE) ..... 10 2010 026 154

(51) Int. Cl.
*F41G 1/387* (2006.01)

(52) U.S. Cl.
USPC ..... 42/124

(58) Field of Classification Search
USPC ..... 42/124–128, 148
See application file for complete search history.

(56) References Cited

U.S. PATENT DOCUMENTS

| | | | | |
|---|---|---|---|---|
| 2,580,246 | A * | 12/1951 | Schall | 42/127 |
| 4,959,908 | A * | 10/1990 | Weyrauch | 42/124 |
| 5,035,487 | A * | 7/1991 | Herz | 359/896 |
| 6,594,938 | B2 * | 7/2003 | Horton | 42/127 |
| 7,444,776 | B2 * | 11/2008 | Adams | 42/127 |
| 8,136,287 | B2 * | 3/2012 | Adams | 42/124 |

* cited by examiner

*Primary Examiner* — Michael Carone
*Assistant Examiner* — Reginald Tillman, Jr.
(74) *Attorney, Agent, or Firm* — Lucas & Mercanti, LLP

(57) ABSTRACT

The object of the invention is to realize further improvements of a telescopic-sight mounting system.
Said object is achieved by a telescopic-sight mounting system 3 for a firearm 1 for mounting a telescopic sight 2 on the firearm 1, said telescopic-sight mounting system 3 having a locking retainer 7 that can be fixed on the firearm 1 and a locking foot 6 that can be fixed on the telescopic sight 2. The invention is characterized by an improved contact geometry between the locking retainer 7 and the locking foot 6.

14 Claims, 5 Drawing Sheets

TELESCOPIC-SIGHT MOUNTING SYSTEM FOR A FIREARM

This application claims the priority of DE 10 2010 026 154.8 filed Jul. 5, 2010, which is incorporated by reference herein.

The invention relates to a telescopic-sight mounting system.

Hunting weapons are usually equipped with a telescopic sight that is mounted on the hunting weapon and aligned therewith. Such telescopic sights usually comprise an aiming device, e.g., a reticule, wherein the reticule is set to that point through which a projectile fired from the hunting weapon is to go. It is thus possible to sight and precisely hit, e.g., a head of game or a mark with the hunting weapon by means of the telescopic sight.

It is sometimes necessary to detach the telescopic sight from the hunting weapon, e.g., for maintaining or inspecting the hunting weapon or for transporting it. In order to enable the telescopic sight to be reproducibly mounted on the hunting weapon, telescopic-sight mounting systems have caught on. Both the telescopic sight and the hunting weapon usually have mechanical interfaces as components of the mounting system that allow reproducible mounting. However, the telescopic sight must be mounted very precisely since even changes in the order of fractions of millimeters or degrees can impair the parallel arrangement of the telescopic sight and the hunting weapon to such an extent that the point defined by the reticule is far from the point hit by the projectile.

The so-called Suhl hook mounting system that connects the telescopic sight to the hunting weapon by means of two interfaces is known as a traditional solution for telescopic-sight mounting systems, wherein one interface is designed as a swivel joint that enables the telescopic sight to be hooked in and swiveled into position in a swiveling plane jointly formed by the barrel and the telescopic sight. The other interface is designed as a locking foot that is inserted into a locking retainer and locked therein.

An already improved Suhl hook mounting system is described in detail in the applicant's Utility Model DE 20 2010 000 947.

The object of the invention is to realize further improvements of a telescopic-sight mounting system.

Said object is achieved by a telescopic-sight mounting system having the features of claim 1. The subclaims, the following description and the attached figures reveal preferred or advantageous embodiments of the invention.

Thus, the subject matter of the invention is a telescopic-sight mounting system for a firearm for mounting a telescopic sight on the firearm. Preferably, the telescopic sight may be an optical system that is particularly equipped with a reticule. Alternatively, the telescopic sight may be designed as an electronic system.

The firearm is used for firing a projectile and is preferably realized as a hunting weapon and particularly as a rifle.

Particularly preferably, the telescopic-sight mounting system has a swivel joint that enables the telescopic sight to be hooked in and swiveled into position in a swiveling plane shared with the barrel of the firearm. In a particularly preferred embodiment, the telescopic-sight mounting system is designed as a swivel system and is particularly realized in the manner described in the applicant's Utility Model DE 20 2010 000 947 mentioned above.

The telescopic-sight mounting system comprises a locking interface that is preferably spaced apart from the above-described swivel joint if said swivel joint is present. The telescopic-sight mounting system, particularly the locking interface, comprises a locking retainer that can be fixed on the firearm, and a locking foot that can be attached to the telescopic sight. The other way round, it is also possible that the locking retainer can be fixed on the telescopic sight and that the locking foot can be fixed on the firearm. "Can be fixed" or "can be attached" means that, when the telescopic sight is detached from the firearm, the locking retainer continues to be fixed on the firearm and the locking foot continues to be fixed on the telescopic sight, wherein further components may be interposed.

The locking retainer has a slide, particularly a bolt, as a first locking partner, and the locking foot has a slide retainer as a second locking partner. The telescopic-sight mounting system is designed in such a manner that, in a locking process, the slide is inserted into the slide retainer by a sliding length in a sliding direction that is preferably oriented parallel to the orientation of the firearm and/or of the telescopic sight, said insertion being performed for locking the locking foot in the locking retainer. In particular, the slide is designed as a positive-locking element that keeps the locking foot in the locking retainer in a positive-locking manner and prevents the locking foot from moving away from the firearm.

A sliding surface is assigned to one locking partner, and a running surface is assigned to the other locking partner, wherein the running surface and the sliding surface are displaced relative to each other, for the purpose of locking, in such a manner that they contact each other. When locking, i.e., in the locked state, the sliding surface and the running surface contact each other in a contact region.

According to the invention, it is proposed that when locking, i.e., in the locked state, the sliding surface exposedly projects in a region that has moved, particularly in a contacting manner, over the running surface, i.e., it is provided that, during the locking process, at least a part of the sliding surface contacts the running surface and moves over it and exposedly projects behind the running surface after said moving-over process. The moving-over process is a relative motion between the sliding surface and the running surface so that the sliding surface or the running surface may be moved for the purpose of locking.

The invention may alternatively or additionally provide that the area measure of the area of contact between the sliding surface and the running surface during the insertion of the slide corresponds to the area measure of the contact region in the locked state. The area measure corresponds to the area in which the sliding surface and the running surface contact each other. For example, in a first step, the area of contact between the sliding surface and the running surface is measured when the slide is, during the insertion process, in an intermediate position and not in its end position yet. After that, the area of the region of contact between the sliding surface and the running surface is measured when the slide is in its end position. The two areas have the same size. Preferably, it is also claimed that the area measure of the contact area during the insertion of the slide is always constant after reaching the area measure of the contact region.

Alternatively or additionally, the invention may be presented in such a manner that the running surface in the sliding direction is shorter than the sliding length and/or than the sliding surface.

In this context, the invention is based on the idea that the reproducibility of locking and thus of adjusting the telescopic sight on the firearm can be considerably improved by reducing the size of the running surface in comparison with the size of the sliding surface. The fact that the running surface is considerably smaller than the sliding surface gives particularly rise to the expectation that effects based on static friction or sliding friction between the functional surfaces will be considerably reduced.

Alternatively or additionally, the invention may be presented in such a manner that the running surface and/or the sliding surface are/is curved in a longitudinal section parallel to the sliding direction. The size of the contact region is reduced on account of the curvature of one surface or of both surfaces. Said curvature may be designed as a radius with a uniform course of curvature. As an alternative thereto, the curvature has a free shape with a changing course of curvature in the sliding direction. The curvature is particularly preferably convex and/or bulged and/or outwardly curved.

Experiments with the new telescopic-sight mounting system have shown that particularly the shooting precision with regard to the reproducibility of shooting behavior can be considerably improved by the inventive modification. The diameter of the circle of dispersion of a series of shots is improved by using the inventive telescopic-sight mounting system, too. The circle of dispersion is the local distribution of points hit by the projectiles in the region of a target, wherein a circle of dispersion is improved when the points hit by the projectiles are closer to each other or when the diameter of the circle of dispersion is smaller. The reproducibility of shooting behavior is considerably improved on account of the changed constructional embodiment of the functional surfaces, i.e., of the sliding surface and of the running surface.

One possible constructional embodiment of the invention provides that the length, particularly the average or maximum length, of the running surface in the sliding direction is smaller than 3 mm, preferably smaller than 2 mm and particularly smaller than 1 mm. A comparison thereof with a typical sliding length and/or sliding-surface length in the sliding direction of more than 2 mm, preferably of more than 3 mm and particularly of more than 4 mm, elucidates that the running surface can only take up a small area of the sliding surface during the contacting process.

In a particularly preferred embodiment of the invention, the contact region is realized as a line region. Preferably, the line region runs perpendicular to the sliding direction. On account of the so-called Hertzian stress, the line region may be degenerated in the locked state in such a manner that it forms a widened line region. It is to be emphasized that the contact region during the insertion of the slide may be designed as a line region, too.

The designing of the contact region as a line region and/or the designing of the sliding surface and/or of the running surface with a curvature in a longitudinal section parallel to the sliding direction can also enable locking to be tolerant with regard to an angle deviation of the telescopic-sight mounting system in a plane jointly formed by the telescopic sight and the barrel of the firearm. Said angle deviation manifests itself as a slight torsion of the locking retainer relative to the slide retainer about a region in which the contact region lies or is at least adjacent thereto. The angle tolerance is achieved by enabling the locking retainer to compensatively swivel relative to the slide retainer about the line region and/or to compensatively roll over the curvature without the occurrence of any locking instabilities.

In a preferred constructional embodiment according to claim 1 or according to the preamble of claim 1 of the invention, the running surface is curved in a longitudinal section parallel to the sliding direction. For example, the curvature may be realized as a partial circle or with a free shape in the mentioned longitudinal section. The curved running surface and the preferably even sliding surface enable, e.g., the line region to be formed as a contact region.

In another embodiment of the invention, the contact region is designed as a two-dimensional region. In this embodiment, the contact region extends in the sliding direction as well as perpendicular thereto. In particular, the contact region is realized as a rectangular region.

In one possible constructional realization, the running surface is designed, in the longitudinal section parallel to the sliding direction, as a surface that is even and particularly parallel to the sliding surface.

In the mentioned embodiments, the shape of the running surface ensures that the contact region has a defined and limited area and that the contact area has, particularly during insertion, a constant area measure.

In an advantageous further development of the invention, the sliding surface is designed as an even surface and realized in a longitudinal section parallel or almost parallel to the sliding direction with a sliding angle bent relative to the sliding direction. In particular, the sliding surface is designed as a wedge surface. Because of this realization, a force in a radial direction is steadily increased with the sliding length when the running surface and the sliding surface are displaced relative to each other so that the locking foot is pressed or pulled towards the firearm.

In a preferred constructional realization of the invention, the sliding angle is larger than 2 degrees, preferably larger than 3 degrees, and is particularly 4 degrees. This steep sliding angle enables the locking foot to be firmly and reproducibly fixed in the locking retainer even if the way of displacement is short.

In a particularly preferred embodiment of the invention, the sliding surface is formed on the slide and the running surface is formed by a form on the slide retainer. In principle, the running surface could also be arranged on the slide and the sliding surface could also be arranged on the slide retainer.

However, experiments or assessments have shown that the first-mentioned distribution has a positive influence on dispersion behavior or on the dispersion pattern.

In one possible realization of the invention, said form is designed as a flat web or a plateau that extends perpendicular to the sliding direction and whose top side is formed parallel to the sliding surface. Because of the flat web, the contact region is designed as a two-dimensional region.

In another constructional realization, the form is designed as a semicircular web that longitudinally extends perpendicular to the sliding direction. In this realization, the contact region is realized as a line region.

A particularly preferred further development of the invention provides that the slide, in the locked state, is positioned without an end stop. Thus, the slide's pressure acting against the slide retainer is defined by the sliding force in the sliding direction. It may be constructionally provided that the slide is prestressed towards the slide retainer by means of an elastic device, in particular a spring device, so that the slide closes automatically.

Further features, advantages and effects of the invention can be inferred from the following description of a preferred exemplary embodiment of the invention as well as from the attached figures in which FIG. 1 shows a schematic longitudinal section through a firearm with a telescopic sight and a telescopic-sight mounting system as an exemplary embodiment of the invention;

Figure 1:
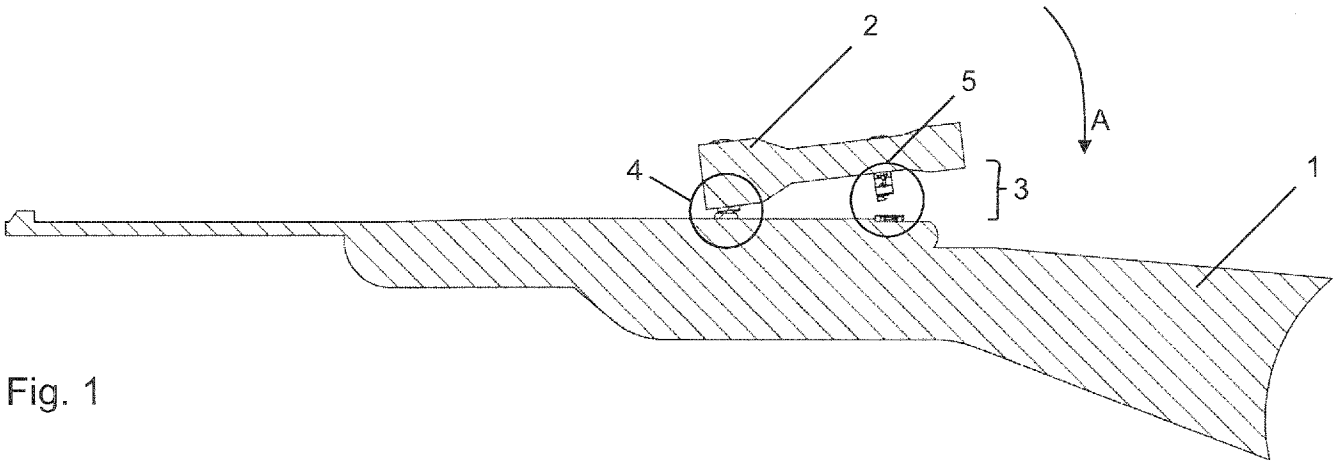

FIG. 1 shows a firearm 1, e.g., a rifle, particularly a hunting rifle, on which a telescopic sight 2 is mounted by means of a telescopic-sight mounting system 3. The telescopic-sight mounting system 3 comprises a swivel joint 4 and a locking joint 5 as a locking interface that is spaced apart from the swivel joint 4. During the mounting process, the telescopic sight 2 is hooked into the swivel joint 4 in a first step, and, in a next step, swiveled about the swivel joint 4 according to arrow A in such a manner that the locking joint 5 locks the telescopic sight 2 on the firearm 1. In principle, such a system of mounting the telescopic sight 2 on the firearm 1 is known as the Suhl hook mounting system.

Figure 2:
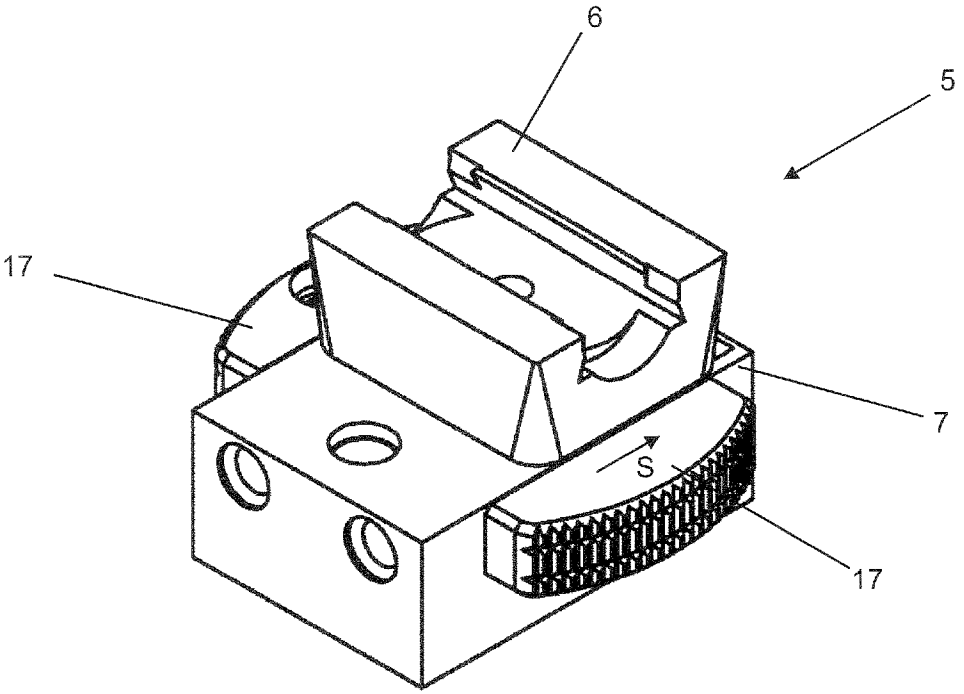
FIG. 2 shows a schematic three-dimensional representation of a locking interface of the telescopic-sight mounting system in FIG. 1.

FIG. 2 shows a schematic three-dimensional representation of the locking joint 5 of FIG. 1. The locking joint 5 comprises a locking foot 6 fixed on the telescopic sight 2 and a locking retainer 7 that can be fixed on the firearm 1. Further intermediate elements can be used for the fixing of the components on the firearm 1 or of the telescopic sight 2.

Figure 3:
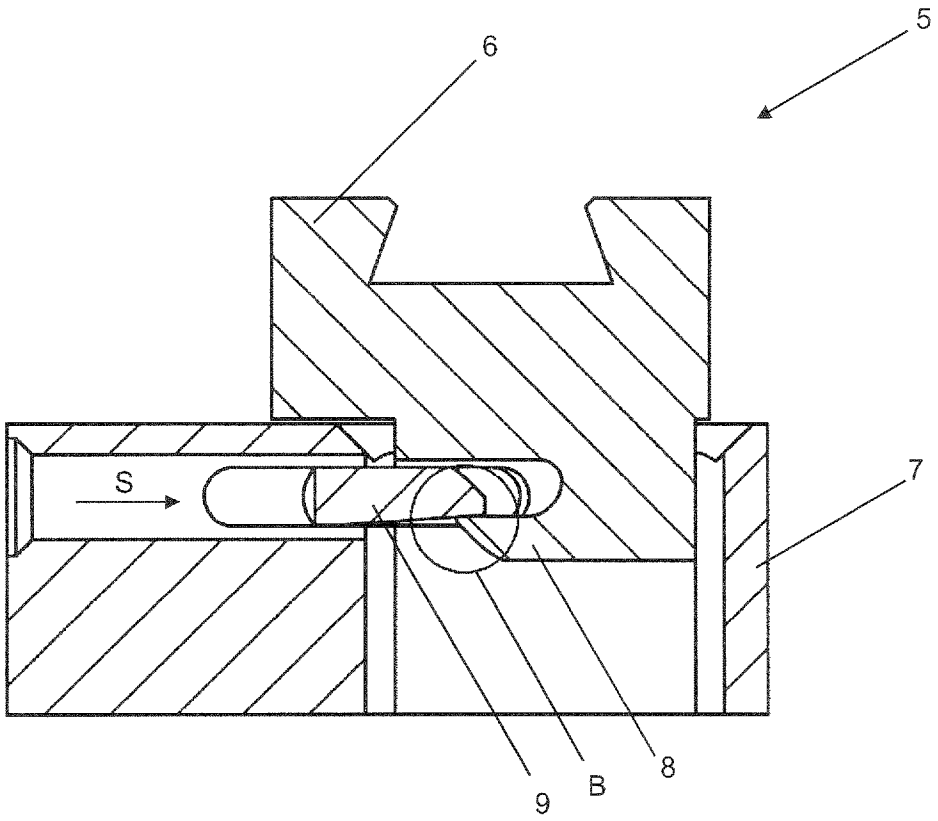
FIG. 3 shows a longitudinal section through the locking interface in FIG. 2.

FIG. 3 shows a schematic longitudinal section through the locking joint 5 for providing a better illustration of the internal construction. The locking foot 6 has a hook portion 8 that is inserted into the locking retainer 7 during the mounting of the telescopic sight 2 on the firearm 1. The locking foot 6 even has a total of two hook portions 8 that are separated from each other but arranged congruently in the view of FIG. 3. The two hook portions 8 are inserted into two separate slots in the locking retainer 7. As an alternative thereto, the design may be modified in such a manner that there is only one hook portion. The hook portions 8 are oriented in such a manner that they are open towards a slide 9 in the locking retainer 7. The slide 9 is movably supported in the locking retainer 7 in a sliding direction S and can be inserted into the hook portions 8 by a sliding length L (FIGS. 4 and 5) after the insertion of the hook portions 8 into the locking retainer 7. The hook portions 8 thus form a slide retainer. In addition to their function of forming a slide retainer, the hook portions 8 form positive-locking end stops that rest on stop faces (not shown) of the locking retainer, thereby limiting, in a positive-locking manner, the swiveling motion of the telescopic sight 2 according to arrow A in the sliding direction. In this context, the tolerance of the locking system with regard to angle deviations is to be emphasized again: Said tolerance results in enabling locking to be reproducible even if the slide retainer has to be locked when it is slightly swiveled about the stop faces.

The slide 9 is spring-loaded so that it moves into the hook portions 8 automatically. For unlocking, the slide 9 is laterally coupled to two grips 17 (see FIG. 2) that can be manually moved against the sliding direction S in order to pull the slide 9 out of the hook portions 8.

Figure 4:
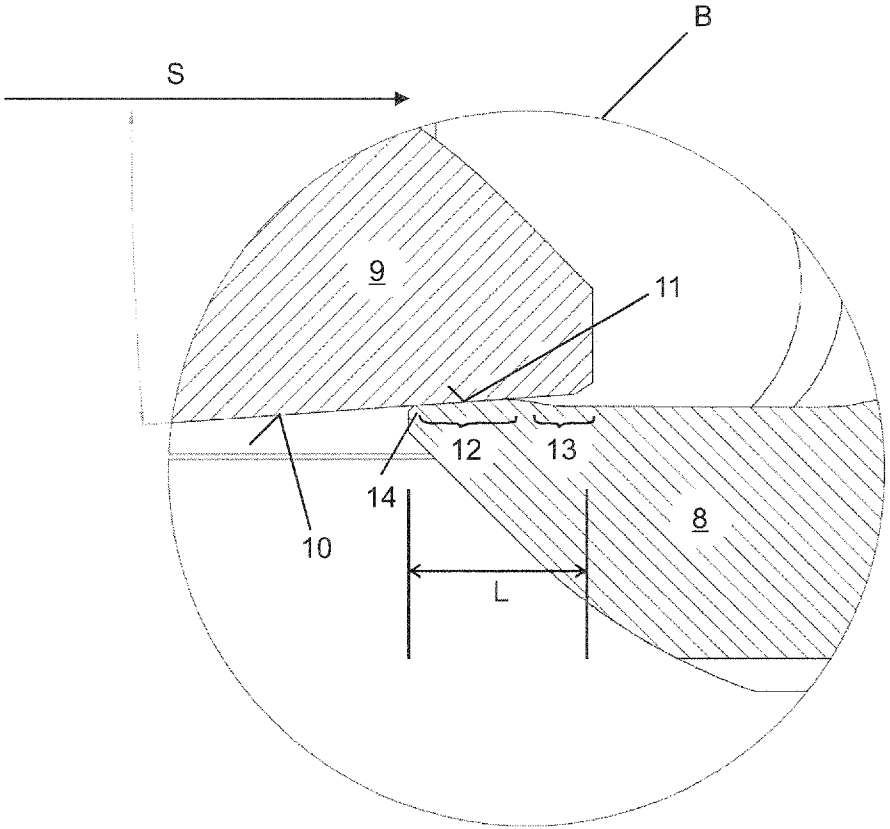
FIG. 4 shows detail B in FIG. 3 in a first possible embodiment of the invention.

FIG. 4 shows a blow-up of detail B in FIG. 3. This representation shows that a sliding surface 10 is arranged on the lower side of the slide 9 and that a running surface 11 is arranged on the top side, in the free edge region of the hook portion 8. In the shown locked state of the locking joint 5, the sliding surface 10 and the running surface 11 contact each other in a contact region 12.

For locking, the sliding surface 10 of the slide 9 moves, in the sliding direction S, over the running surface 11 until a free region 13 of the sliding surface 10 exposedly projects over the running surface 11 and the contact region 12 in the sliding direction S. For maintaining this geometry, the hook portion 8 has a flat web region 14 on its free end, which flat web region 14 longitudinally extends perpendicular to the sliding direction S. The flat web region 14 extends for about 0.5 mm in the sliding direction S. The top side of the flat web region 14 forms the running surface 11 that is oriented parallel to the sliding surface 10 and contacts it all over. The top side of the hook portion 8 is reduced in the sliding direction S behind the flat web region 14 so that the free region 13 is formed.

With the geometry shown, the contact region 12 is thus limited to the spatial extension of the flat web region 14 with the running surface 11. Therefore, the contact region 12 is not steadily increased but is limited when the slide 9 is closed.

The sliding surface 10 is inclined relative to the sliding direction S by a sliding angle $\alpha$ of about 4 degrees so that the pressure of the slide 9 on the hook portion 8 is steadily increased in a radial direction towards the firearm 1 when the slide 9 is closed.

Figure 5:
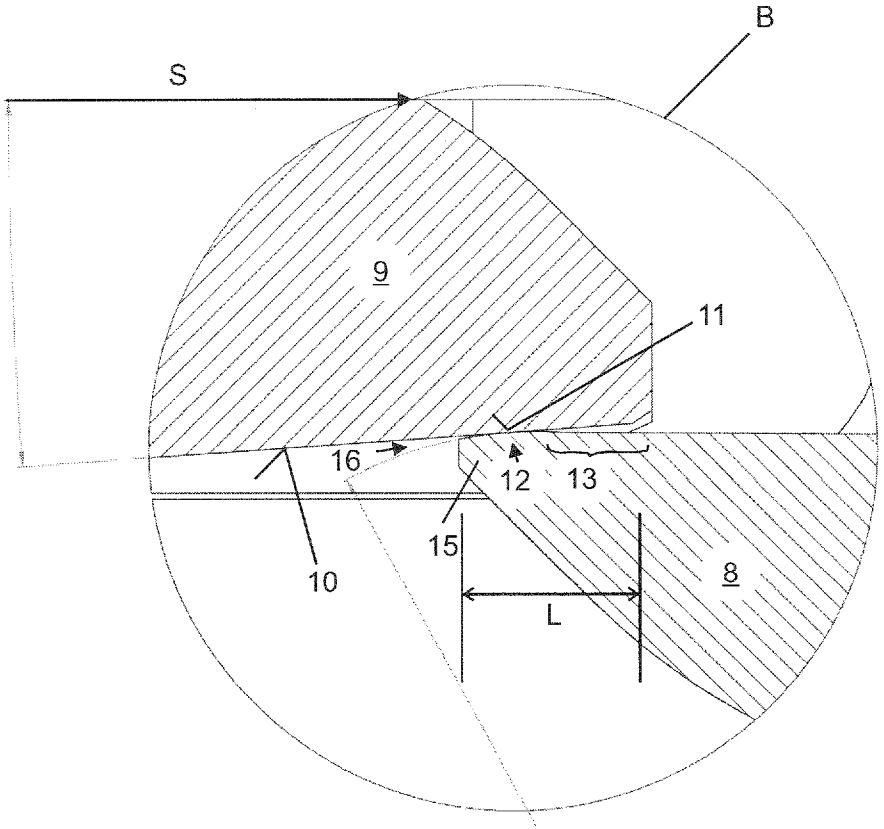
FIG. 5 shows detail B in FIG. 3 in a further embodiment of the invention.

FIG. 5 shows an alternative embodiment of the contact geometry, wherein a semicircular web region 15 is used instead of a flat web region 14. In the longitudinal section shown, the semicircular web region 15 has a curvature with a radius R so that only a line contact extending perpendicular to the sliding direction S is formed as a contact region 12. The semicircular web region 15 is molded on a free end of the hook portion 8 so that a gap is formed between the hook portion 8 and the slide 9 in the free region 13 and a further gap 16 is formed in the edge region of the hook portion 8. The further gap 16 is advantageous since the loading by the contact region does not directly act upon the edge region of the hook portion 8 but is transferred to an internal region thereof. The advantage of this design consists in the fact that angle deviations between the locking retainer 7 and the locking foot 6 are tolerated.

LIST OF REFERENCE NUMERALS

1 firearm
2 telescopic sight
3 telescopic-sight mounting system
4 swivel joint
5 locking joint
6 locking foot
7 locking retainer
8 hook portions
9 slide
10 sliding surface
11 running surface
12 contact region
13 free region
14 flat web region
15 semicircular web region
16 gap
17 grips

The invention claimed is:

1. A telescopic-sight mounting system for mounting a telescopic sight on the firearm, comprising:

a locking retainer that can be fixed on one of the firearm or the telescopic sight, and a locking foot that can be fixed on the other of the firearm or the telescopic sight;

wherein the locking retainer has a slide as a first locking partner and the locking foot has a slide retainer as a second locking partner;

wherein the slide can be inserted into the slide retainer by a sliding length in a sliding direction for locking the locking foot in the locking retainer;

wherein a sliding surface is assigned to one locking partner and a running surface is assigned to the other locking partner;

wherein the sliding surface and the running surface contact each other in a contact region when locking;

wherein the locking partners are designed such that, when locking, the sliding surface exposedly projects in a region that has moved over the running surface;

wherein either the running surface is formed by a form on the slide retainer and the sliding surface is formed on the slide, or the running surface is formed by a form on the slide and the sliding surface is formed on the slide retainer; and wherein the form is designed as a flat web, a plateau, a semi circular web, or a convex web that extends perpendicular to the sliding direction.

2. The system of claim 1, wherein the length of the running surface in the sliding direction is smaller than 3 mm.

3. The system of claim 1, wherein the contact region is designed as a line region.

4. The system of claim 1, wherein the contact region is designed as a two-dimensional region.

5. The system of claim 1, wherein the sliding surface is designed as an even surface and, in a longitudinal section parallel to the sliding direction, with a sliding angle bent relative to the sliding direction.

6. The system of claim 5, wherein the sliding angle is larger than 2°.

7. The system of claim 1, wherein the slide, in the locked state, is positioned without an end stop.

8. The system of claim 1, wherein the area measure of an area of contact between the sliding surface and the running surface during the insertion of the slide corresponds to the area measure of the contact region.

9. The system of claim 1, wherein the running surface in the sliding direction is shorter than the sliding length and/or than the sliding surface.

10. The system of claim 1, wherein the sliding surface is curved in the contact region in a longitudinal section parallel to the sliding direction.

11. The system of claim 2, wherein the length of the running surface in the sliding direction is smaller than 2 mm.

12. The system of claim 11, wherein the length of the running surface in the sliding direction is smaller than 1 mm.

13. The system of claim 6, wherein the sliding angle is larger than 3°.

14. The system of claim 13, wherein the sliding angle is larger than 4°.

* * * * *